United States Patent [19]

Gardner et al.

[11] 4,000,888

[45] Jan. 4, 1977

[54] WEB SEVERING DEVICE

[76] Inventors: Frank H. Gardner, 828 Highview St., Joplin, Mo. 64801; David L. Dimmitt, 638 Marin Ave., Ontario, Calif. 91761

[22] Filed: July 17, 1975

[21] Appl. No.: 596,813

[52] U.S. Cl. ..... 270/21; 83/587; 83/DIG. 1

[51] Int. Cl.[2] ..... B41F 13/56

[58] Field of Search ..... 270/21; 83/60, 371, 83/586, 587; 100/265; 192/22

[56] References Cited

UNITED STATES PATENTS

| | | | |
|---|---|---|---|
| 1,951,433 | 3/1934 | Millingar | 83/60 |
| 2,029,726 | 2/1936 | Laabs | 83/371 |
| 2,389,376 | 11/1945 | Mandin | 83/587 |
| 3,272,049 | 9/1966 | Cooksey | 83/60 |

*Primary Examiner*—Edgar S. Burr
*Assistant Examiner*—A. Heinz
*Attorney, Agent, or Firm*—John H. Crowe

[57] ABSTRACT

A self-contained web severing device particularly intended for the folder unit of a continuous web printing press comprising a frame supporting a web severing blade in concealed position, the latter being released for spring operated web severing movement by break sensing devices in the paths of those webs passing through the severing device. The blade also acts to deflect the leading end of the severed web or webs out of the folder unit. Safety means prevent accidental release of the blade during periods when the web or webs are being threaded through the press or the press is being otherwise worked on.

7 Claims, 10 Drawing Figures

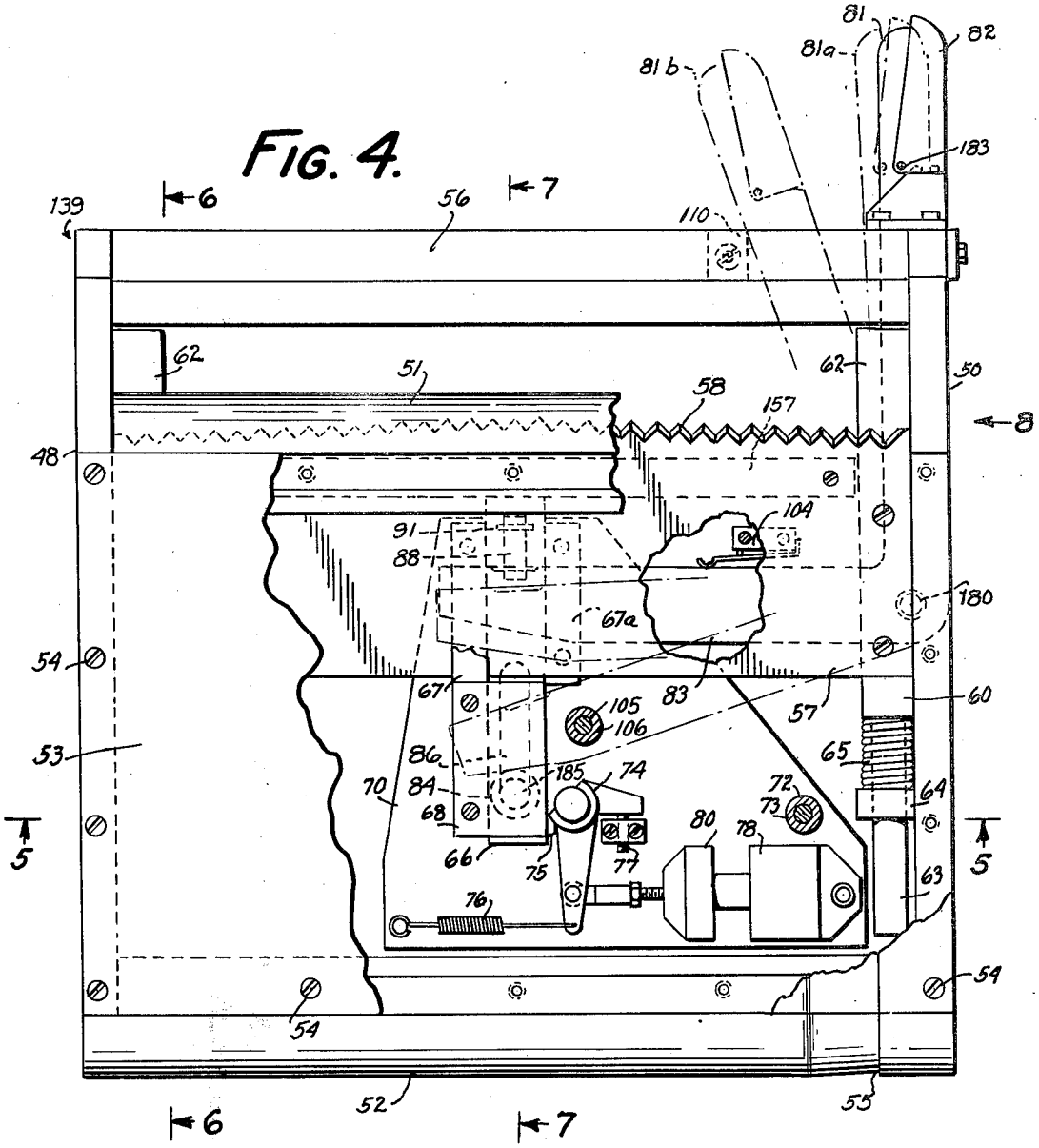
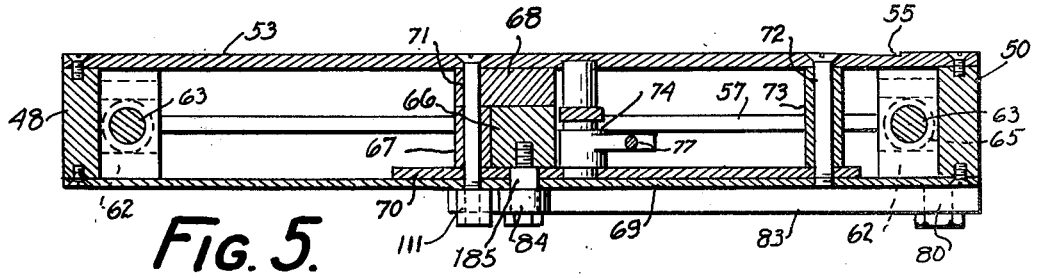
FIG. 5.

WEB SEVERING DEVICE

BACKGROUND OF THE INVENTION

This invention relates to web severing devices for continuously moving webs and has particular reference to a severing device for a paper web or webs passing through a printing press.

Web severing devices have been used heretofore in conjunction with sensing devices which sense a continuously traveling web passing through a printing unit and which activate the severing device in the event of a break or tear in the web. Such severing devices usually sever the web at a point prior to entry of the web into the printing unit to prevent wrap-up of the leading end of the torn portion of the web around various cylinders, rollers or guides to the extent that it an damage the press or its components.

In large printing plants, such as are used in the newspaper printing art, a number of printing units are provided to print on one or both sides of several webs, and such webs are fed in superposed relation through a folder unit where they are passed over various formers, folding rollers, cutting and folding cylinders, etc. to form the finished newspaper or similar product. As the webs pass through the various printing units and into the folder unit, they generally are fed over several power driven feed rollers, such as drag rollers, forming rollers, nip rollers, etc. which are driven at progressively higher peripheral speeds as the webs approach the folder unit so as to apply a progressive gain or tension to each web for the purpose of keeping the same taut as it travels through the folder unit. This prevents wrinkling of the paper and also enables accurate registration between the several webs. However, if a break occurs in a web as it passes through a printing unit or at any point intermediate the printing unit and the folder unit, the sudden release in tension in the web causes a wave or surge to travel along the length of the web and through the folder unit. Such surge tends to change the registration of the torn web relative to the remaining webs and also tends to wrinkle or bunch such torn web at points where it passes between certain cylinders or rollers in the folder unit, causing jamming and other damage before the press can be stopped. Also, considerable time is generally consumed in removing the jammed web preparatory to rethreading the same through the folder unit.

SUMMARY OF THE INVENTION

A principal object of the present invention is to instantly sever one or a plurality of superposed webs passing through a folder unit when a break occurs in one of the webs.

Another object of the invention is to guide the leading end of a severed web out of the folder unit.

Another object is to provide a self-contained web severing device which may be readily mounted in an existing printing press folder unit or the like.

Another object is to prevent accidental actuation of a web severing device.

A further object is to facilitate retraction of a web severing device following a web severing operation.

According to the present invention, a self-contained web severing device is provided which can be readily mounted on the frame of an existing folder unit or the like. A spring actuated severing blade is provided which is normally held in retracted and concealed position and instantly released by an electromagnetic device controlled by a switch which senses a break in the web. The severing blade additionally acts as deflect the leading end of the severed portion of the web out of the folder unit.

BRIEF DESCRIPTION OF THE DRAWINGS

FIG. 4 is a plan view, with parts broken away, of the severing device, illustrating the severing blade in retracted position and the cocking lever in "safety" position.

FIG. 5 is a sectional view taken along the line 5—5 of FIG. 4.

DESCRIPTION OF THE PREFERRED EMBODIMENT

Figure 1:
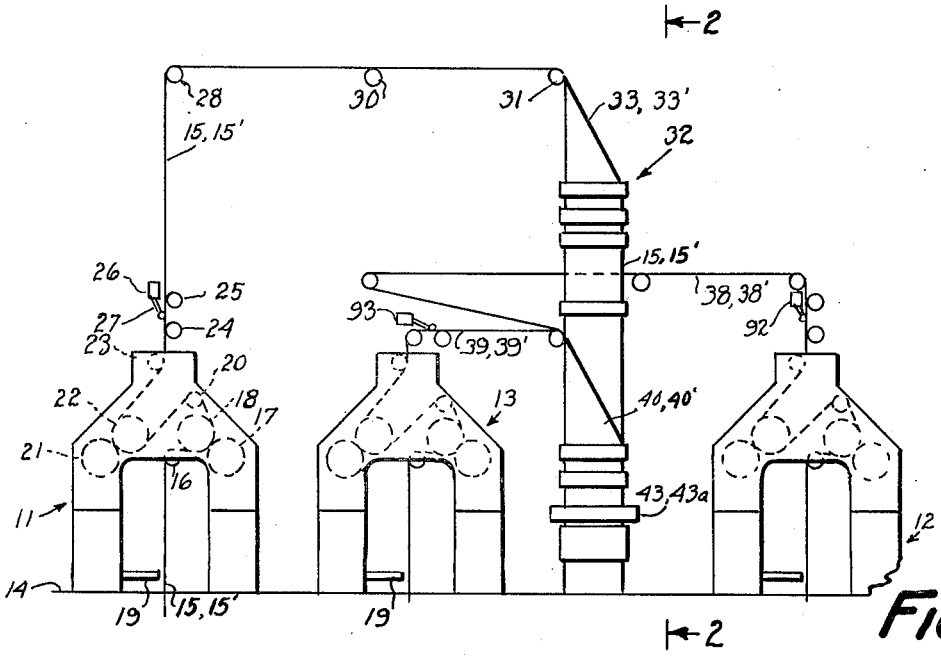
FIG. 1 is a front elevation view of a printing press embodying a preferred form of the present invention.
Figure 2:
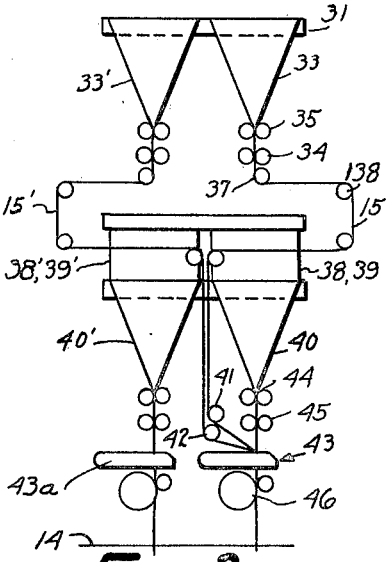
FIG. 2 is a front view of the folder as seen from line 2—2 of FIG. 1.

Referring in particular to FIGS. 1 and 2, a newspaper or the like printing press is shown therein comprising a plurality of printing units generally indicated at 11, 12 and 13, spaced along a floor surface 14. Such printing units are of similar and conventional construction and reference may be had, for example, to the U.S. Pat. No. 2,383,970 issued on Sept. 4, 1945, to W. F. Huck for a more complete disclosure of the details thereof. However, it is to be understood that the present invention is not limited to the particular type of printing unit or folder unit disclosed herein.

Referring to the printing unit 11 in more detail, a pair of paper webs 15,15' passing therethrough in side-by-side relation are led from suitable supply rolls (not shown) located below the floor surface 14 and are guided past conventional web severing devices 19, over a roller 16 and between a plate cylinder 17 and an impression cylinder 18, forming a first printing couple, whereby to print on one side of the webs 15,15'. The latter are then guided over a guide roller 20 and between plate cylinder 21 and impression cylinder 22, forming a second printing couple, to print on the opposite side of the webs. The printed webs 15 and 15' are then guided upwardly over roller 23 and past two closely spaced guide rollers 24 and 25. Break sensing switches 26 are located adjacent the rollers 24 and 25 and have feeler arms 27 which ride in contact with portions of the webs passing between the rollers 24 and 25 (see also FIG. 3). The webs 15 and 15' continue upward and over various drag rollers 28, 30, and 31 which are driven at progressively higher peripheral speeds as the webs approach a folding unit generally indicated at 32 so as to apply a progressive gain or tension to each web. The folder unit 32 comprises upper balloon formers 33 and 33' over which the webs 15 and 15' are guided to fold the same along medial lines.

A set of nip rollers 34 drawn the folded web 15 through a set of forming rollers 35 and it then progresses over guide roller 37, compensating roller 138 and additional guide rollers where it is associated with other webs, i.e. 38, 39 led from respective printing units 12 and 13. In this exemplary illustration, the webs 15 and 15' are separately guided over similar rollers and are finally guided under rollers 41, 42, respectively, and through a web severing device generally indicated at 43, forming the subject matter of the present invention. The webs 15 and 15' then pass in superposed relation between additional cylinders 46 and other folding equipment (not shown).

The webs 38 and 39 are likewise led under tension over various driven rollers and finally converge in contact with each other and are guided over a folder 40 and between forming rollers 44 and nip rollers 45 and then pass through severing device 43 in paths adjacent the paths of webs 15 and 15'. The webs 38', 39' are similarly guided over a folder 40' and through the second severing device 43*a*, identical to device 43.

Describing now the web severing device 43 in detail, reference is had to FIGS. 4 to 10 wherein the device comprises a rectangular frame 139 including spaced side frame bars 48 and 50 integral with spaced guide bars 51 and 52. An upper cover plate 53 is secured by screws 54 to the bars 48, 50, 51 and 52.

It will be noted that the guide bars 51 and 52 are rounded and blend with the upper surface of plate 53 to form guide means for the various webs whereby they may be led to the severing device 43 at different angles. For example, the webs 15 and 15' are guided at converging angles over the forward guide bar 51 and then downwardly adjacent the path of superposed webs 38, 39. However, an additional web, such as shown at 154, may be guided upwardly from a suitable source (not shown) and over the rear guide bar 52 and along the cover plate 53 to also be guided downwardly over the guide bar 51 in contact with webs 15 and 15'.

In order to properly guide the folded webs, the guide bars 51 and 52 and cover plate 53 are undercut slightly at 55 adjacent their right hand ends as seen in FIGS. 4 and 5 to receive the creased edges of the webs as they pass thereover.

A spreader bar 56 is integrally connected to the side bars 48 and 50 and extends across the paths of the various webs on the sides thereof remote from the guide bar 51.

A web severing blade 57 is provided within the frame 139 and has a sharp toothed web severing edge 58 normally located in a concealed position below the guide bar 51. The edge 58 is also slightly convex or bowed rearwardly, as viewed in FIG. 4, to facilitate severing of the web. The blade 57 is secured at its opposite ends to support bars 60 (FIGS. 4 and 6) which are slideably mounted between upper and lower guide bars 61 and 62, respectively, suitably secured to the side frame bars 48 and 50. Each support bar 60 has a rearwardly projecting portion 63 which is slideably mounted in a bearing block 64 and a blade actuating spring 65 is compressed between a portion of the support bar 60 and the bearing block 64. A stiffener bar 157 is secured along the bottom of the blade 57 to resist deflection of the blade.

Also secured to the blade 57 is a center bar 66 (FIGS. 4, 5 and 7) which is guided for endwise movement in slide bearings 67, 67*a* and 68. The center bar 66 is also slideably mounted on a support plate 70 clamped in place against a bottom cover plate 69 by screws 71 and 72 extending through the bearings 67, 68 and through a spacer bushing 73. Plate 69 is additionally clamped in place by a screw 105 which extends through a spacer bushing 106 and is threaded into the bottom plate 69. The bottom cover plate 69 is suitably secured to the side bars 48 and 50. The top and bottom cover plates 53 and 69, respectively, serve as frame members and also keep dust and dirt from falling onto the operating parts of the severing device.

Normally, the severing blade 57 is held in its illustrated cocked or retracted position by a trigger member 74 which is pivoted at opposite ends in bearings formed in the upper cover member 53 and the support plate 70, the member 74 forming a sear which normally engages a projection 75 on the center bar 66. A tension spring 76 normally holds the trigger member 74 in its illustrated latching position against an adjustable stop screw 77.

Release of the blade 57 by the trigger 74 is effected by a solenoid 78 which, when energized, retracts its armature 80 connected to the trigger member 74 to rock the trigger member counterclockwise, releasing the severing blade. Upon such release, blade 57 is quickly advanced to the right in FIGS. 6 and 7 by its springs 65 to sever all of the superposed webs passing through the frame 139 and comes to rest in its dot-dash line position 57' directly over a portion of the spreader bar 56 where it blocks the leading severed ends of the webs from passing through the remainder of the folder unit. Blade 57, along with spreader bar 56, then serves to deflect such leading edges of the webs to the right, out of the folder unit.

In order to return the severing blade 57 to its illustrated cocked position after a web severing operation, a cocking lever 81 is pivoted at 180 below the bottom cover plate 69 and has an arm 83 which is engageable with a roller 84 rotatably mounted on a bolt 185 secured to the center bar 66 and extending through aligned slots 86 in the plates 69 and 70. Guides 110 and 111 guide opposite ends of the cocking lever 81 against lateral movement.

The cocking lever 81 is manually movable between three positions including a "safety" position shown in full lines in FIG. 4, a "release" position depicted by dot-dash lines 81*a* and a "cocking" position depicted by dot-dash lines 81*b*. A locking handle 82 is pivotally mounted at 183 on the lever 81 and is urged clockwise by a compression spring 184 (FIG. 10) into either of two notches 85 and 86 formed on a latching bracket 87 which is suitably secured to the frame 139.

Figure 7:
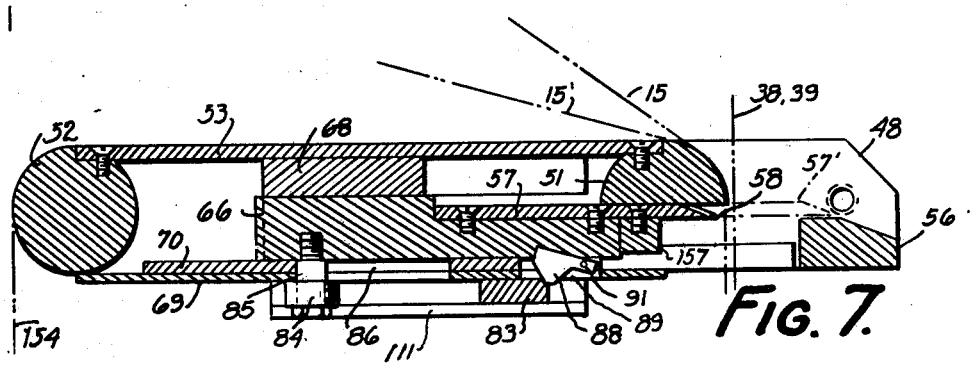
FIG. 7 is a transverse sectional view taken along the line 7—7 of FIG. 4.
Figure 8:
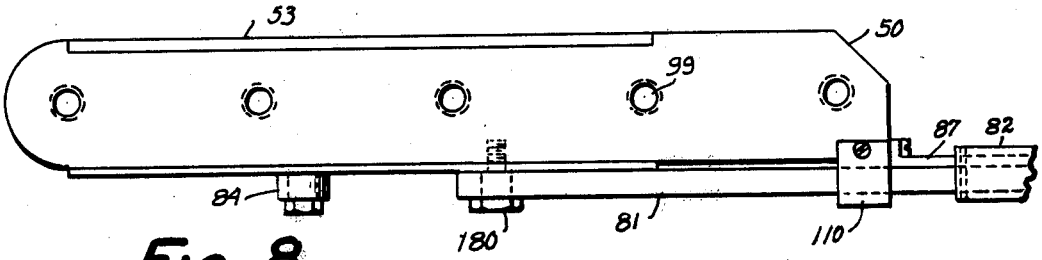
FIg. 8 is a side elevation view of the severing device and is taken in the direction of the arrow 8 in FIG. 4.
Figure 9:
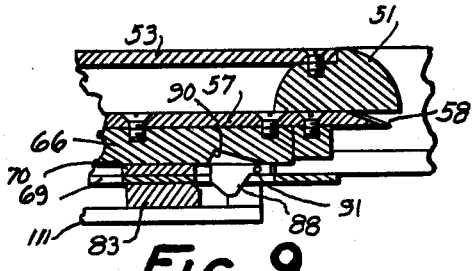
FIG. 9 is a transverse sectional view, similar to FIG. 7, but with parts broken away, illustrating the safety latch in a released position.
Figure 10:
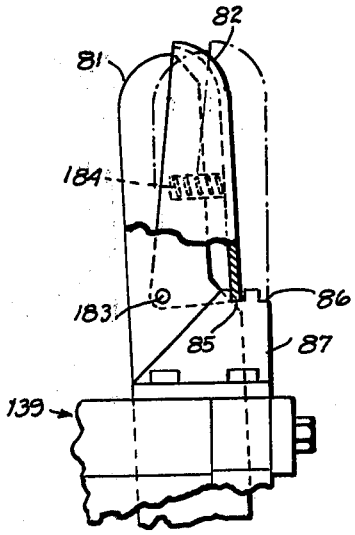
FIG. 10 is an enlarged view of the outer end of the cocking lever, illustrating the same is released position.

Normally, the cocking lever 81 is set in its release position shown in full lines in FIG. 10 (dot-dash lines 81*a* in FIG. 4) wherein it can not impede the spring actuation of the severing blade 57. In such position, the arm 83 of the cocking lever is spaced from a safety latch 88, as shown in FIG. 9, allowing the latch to be held by gravity in its lower illustrated position out of engagement with a locking notch 90 formed in the center bar 66. Latch 88 moves within a slot 89 formed in the plates 69 and 70 and is pivoted at 91 to the support plate 70. However, in cases where it is desired to prevent inadvertent release of the severing bar by accidental energization of solenoid 78, as when pressmen are working on the folder unit, the cocking lever 81 is moved to its safety position causing its arm 83 to cam the safety latch 88 clockwise about its pivotal support 91 into locking engagement with notch 90, as shown in FIG. 7. This positively prevents release of the severing bar 57 even though the solenoid may be energized.

In order to recock the severing bar 57 following a severing operation, the cocking lever 81 is swung counterclockwise to its cocking position 81*b* causing arm 83 to engage roller 84 and retract the severing blade. During such movement the projection 75 engages the trigger member 74 and rocks the same counterclockwise until the severing blade is fully retracted at which time the spring 76 returns the trigger member to latching position.

Threaded holes 99 are located along both side frame bars 48 and 50 to facilitate mounting of the severing device at any desired location on the framework of the folder unit 32.

Figure 3:
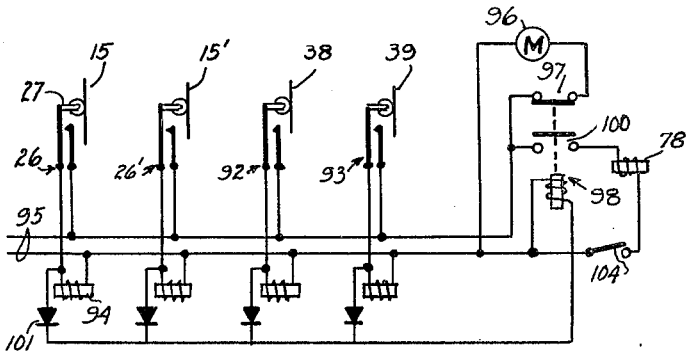
FIG. 3 is a schematic wiring diagram of the press and of the controls for the severing device of the present invention.
Figure 6:
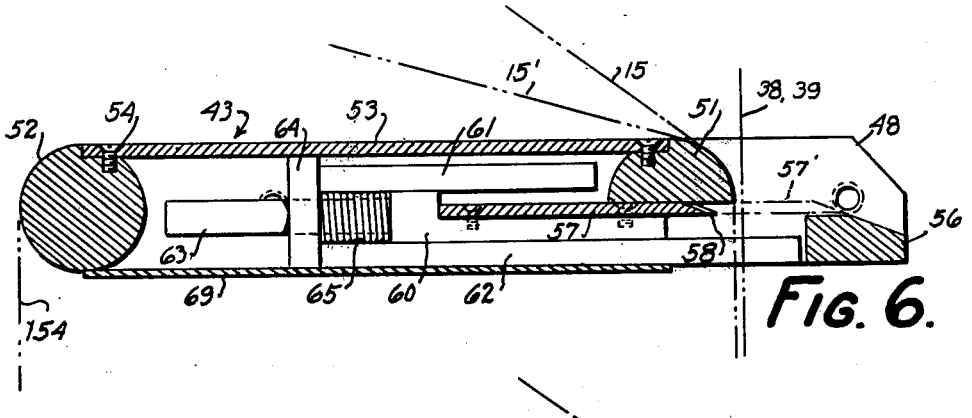
FIG. 6 is a sectional view taken along the line 6—6 of FIG. 4.

Describing now the operation of the web severing device 43 in cooperation with the printing press, reference is had to FIGS. 1 and 3 wherein it will be noted that the various webs i.e. 15, 15′, 38, 39 have normally closed break sensing switches 26, 26′ 92, 93, respectively, associated therewith. Such switches are normally held in open condition by their respective webs and are connected in series with respective solenoids i.e. 94, of respective conventional severing devices, i.e. 19, associated with the different printing units, across the lines of a power circuit 95.

The printing press motor 96 for driving the various printing units 11, 12 and 13 and folder unit 32 is also connected across the lines of the power circuit 95, in series with normally closed contacts 97 of a relay 98.

According to the present invention, the solenoid 78 of the severing device 43 is connected in series with normally open contacts 100 across the lines of the power circuit 95. An energizing circuit for the coil of relay 98 is provided, comprising isolating diodes 101, etc. connected in series with respective ones of the switches i.e. 26, and in circuit with the coil of relay 98 across the lines of power circuit 95.

In the event of a break in any of the webs 15, 15′, 38, 39, the respective switch i.e. 26, 26′, 92, 93 will close to cause severing of the respective web before passing through its respective printing unit and, simultaneously, a signal will be transferred through the respective diode, i.e. 101, to energize relay 98, thus deenergizing the motor 96 and energizing solenoid 78 to cause actuation of the web severing device 43.

As a further safety measure, a normally closed microswitch 104 (FIGS. 3 and 4) is mounted on the bottom cover 69 and is moved to open condition by arm 83 when the cocking lever 81 is in its safety position. Such micro-switch is located in series with the solenoid 78 and thus prevents energization of such solenoid due to inadvertent closing of any of the break sensing switches 26, etc.

Having thus described the invention, it is not intended that it be so limited since changes and modifications may be made thereto without departing from the scope of the invention. Accordingly, it is intended that the subject matter described above and shown in the drawings be interpreted as illustrative only and not in a limiting sense.

We claim:

1. A device for severing an endwise traveling web of a printing press or the like comprising
- a web severing blade,
- spring means for actuating said blade through a web severing movement from a retracted position,
- first latch means for latching said blade in said retracted position,
- means for actuating said first latch means, to allow said blade to move through said severing movement,
- second latch means for additionally latching said blade in said retracted position, and
- a manually operable control device,
- said device being movable to a first position, means interconnecting said control device with said blade for concurrently moving said blade to said retracted position,
- said device being movable to a second position to actuate said second latch means to latch said blade in said retracted position, and
- said device being movable to a third position to release said second latch means from said blade.

2. A device as defined in claim 1 comprising
- means for selectively locking said control device in either said second or said third positions.

3. A device as defined in claim 2 wherein said control device positively maintains said second latch means in latching condition when said control device is in said second position thereof.

4. A device as defined in claim 1 wherein said means for releasing said first latch means comprises
- an electric circuit and a switch in said circuit,
- said control device controlling said switch when in certain of said positions thereof.

5. A device as defined in claim 1 wherein said means for releasing said first latch means comprises
- an electric circuit and a switch in said circuit,
- said control device opening said switch when in said second position and closing said switch when in said third position.

6. A device for severing an endwise traveling web of a printing press or the like comprising
- a web severing device,
- spring means for actuating said severing device through a web severing movement from a retracted position,
- first latch means for latching said severing device in said retracted position,
- means for actuating said first latch means to allow said blade to move through said severing movement,
- second latch means for additionally latching said severing device in said retracted position,
- a manually operable control member,
- said member being interconnected with means for moving said severing device to said retracted position upon movement of said member to a first position,
- said member causing said second latch means to latch said severing device in said retracted position upon movement of said member to a second position, and
- said member releasing said second latching means from latching engagement with said severing device upon movement of said member to a third position.

7. A device as defined in claim 6 wherein said means for releasing said first latch comprises
- an electric circuit and a switch in said circuit,
- (said control member) causing said switch to open when in said second position and causing said switch to close when in said third position.

* * * * *